US009050485B2

(12) United States Patent
Huang et al.

(10) Patent No.: US 9,050,485 B2
(45) Date of Patent: Jun. 9, 2015

(54) ELLIPTICAL TRAINER WITH VARIABLE TRACK

(71) Applicant: DYACO INTERNATIONAL INC., Taipei (TW)

(72) Inventors: Hsuan-Fu Huang, Hemei Town (TW); Han-Lin Liu, Hemei Town (TW)

(73) Assignee: DYACO INTERNATIONAL INC., Taipei (TW)

( * ) Notice: Subject to any disclaimer, the term of this patent is extended or adjusted under 35 U.S.C. 154(b) by 110 days.

(21) Appl. No.: 13/842,298

(22) Filed: Mar. 15, 2013

(65) Prior Publication Data

US 2014/0243157 A1 Aug. 28, 2014

(30) Foreign Application Priority Data

Feb. 25, 2013 (TW) ..... 102106587 A

(51) Int. Cl.

| | |
|---|---|
| ***A63B 22/04*** | (2006.01) |
| ***A63B 69/18*** | (2006.01) |
| ***A63B 22/00*** | (2006.01) |
| ***A63B 22/06*** | (2006.01) |
| ***A63B 22/20*** | (2006.01) |

(52) U.S. Cl.

CPC ..... *A63B 22/001* (2013.01); *A63B 22/0015* (2013.01); *A63B 22/0664* (2013.01); *A63B 22/203* (2013.01); *A63B 2022/0676* (2013.01)

(58) Field of Classification Search

CPC .... A63B 22/00; A63B 22/002; A63B 22/001; A63B 22/0015; A63B 22/0017

USPC ..... 482/51–53, 70, 57

See application file for complete search history.

(56) References Cited

U.S. PATENT DOCUMENTS

| | | | | |
|---|---|---|---|---|
| 5,836,855 | A * | 11/1998 | Eschenbach | 482/57 |
| 5,899,833 | A * | 5/1999 | Ryan et al. | 482/52 |
| 5,997,445 | A * | 12/1999 | Maresh et al. | 482/70 |
| 6,248,046 | B1 * | 6/2001 | Maresh et al. | 482/57 |
| 6,277,054 | B1 * | 8/2001 | Kuo | 482/51 |
| 6,648,800 | B2 * | 11/2003 | Stearns et al. | 482/52 |
| 7,182,714 | B2 * | 2/2007 | Moon | 482/52 |
| 7,201,705 | B2 * | 4/2007 | Rodgers, Jr. | 482/52 |
| 7,223,209 | B2 * | 5/2007 | Lee | 482/52 |

(Continued)

FOREIGN PATENT DOCUMENTS

| | | |
|---|---|---|
| TW | 472598 U | 1/2002 |
| TW | 499973 U | 8/2002 |

*Primary Examiner* — Stephen Crow
*Assistant Examiner* — Garrett Atkinson
(74) *Attorney, Agent, or Firm* — Muncy, Geissler, Olds & Lowe, P.C.

(57) ABSTRACT

An elliptical trainer with a variable track is disclosed. The elliptical trainer has a base, a left and a right linkage, a transmission and a left and a right adjusting assembly. The linkages are connected to an upright posts extending upward from the base, respectively. Each of the linkages includes a pedal set configured to slide with respect to the linkage. The transmission deposited on the upright post drives the pedal sets to perform reciprocal elliptical motions. The adjusting assemblies are pivotally connected to the upright post, respectively, and serve to change an elliptical track along which the pedals move. Thereby, the elliptical track varies by expanding or retracting along only a major axis thereof. When using the elliptical trainer, a user will not need to step higher as the elliptical track expands. This design is more ergonomic and adaptive to users with various body heights and habitus.

3 Claims, 6 Drawing Sheets

(56) References Cited

U.S. PATENT DOCUMENTS 7,674,205 B2 * 3/2010 Dalebout et al. ..... 482/52
8,210,993 B2 * 7/2012 Lee et al. ..... 482/52
2007/0060449 A1 * 3/2007 Lo ..... 482/52
2007/0238582 A1 * 10/2007 Lee ..... 482/52
2012/0115685 A1 * 5/2012 Bedell et al. ..... 482/52

* cited by examiner

ELLIPTICAL TRAINER WITH VARIABLE TRACK

BACKGROUND OF THE INVENTION

1. Technical Field

The present invention relates to elliptical trainers, and more particularly to an elliptical trainer with a variable, track that is adaptable to users with various habitus.

2. Description of Related Art

The conventional elliptical trainer typically has a constant elliptical track to guide a user standing on its pedals to perform reciprocal lower-limb exercise along the constant elliptical track. As the elliptical track is preset, it is impossible for the user to adjust the track according to his/her body height and habitus, rendering his/her exercise rather inconvenient and uncomfortable.

Taiwan Patent No. 472598, for example, provides an adjustable elliptical machine, which comprises a main body lying on the ground. The front and rear ends of the main body are provided with an upright post and a transmission, respectively. The transmission includes a driving wheel. Two links are pivotally connected to two sides of the driving wheel, respectively. The upright post is bilaterally provided with a swinging arm. Each said swinging arm has a lower swinging end that swings to and fro. The swinging end has some a vertical line of equidistant pivotal joints, and the link is pivotally connected to a pedal shaft that is further pivotally connected to the swinging arm. A rail is provided at the middle part of each of the pedal shafts for the corresponding pedal to slide thereon. The pedal is pivotally connected to a rocker arm that is further pivotally connected to the pivotal joint of the swinging arm. Thereby, the driving wheel of the transmission drives the two links to rotate, and each of the link drives the connected end of the pedal shaft to rotate, so that the pedal on the pedal shaft can move along an elliptical track. The elliptical track can be changed by adjusting the stride length of the pedal. Particularly, by changing the site where the rocker arm pivotally connected to the pivotal joint of swinging arm, the elliptical track of the pedal is varied.

However, to perform such an adjustment of the elliptical track in the prior art, the rocker arm has to be first removed from the pivotal joint of the swinging arm, and then reinstalled onto another pivotal joint. In the case that the adjusted stride length is unsuitable to the user, the whole adjusting process has to be repeated, so the known approach to adjusting pedal elliptical tracks is somehow troublesome and inconvenient. In addition, since the transmission is deposited at the rear end of the main body, rendering a rear-driving layout, the range of stride available on the elliptical trainer is limited in view of ergonomic consideration. Particularly, when the elliptical track is of 16" or more, the pedal, when moving to the front end of the elliptical track, will significantly incline, making the user's ankle rotate toward the user himself/herself. This over-bending motion is not only ergonomically disadvantageous but also dangerous to the ankle joint. For this reason, rear-driving elliptical trainers will be finally overridden by front-driving ones.

Efforts have been made to overcome the shortcomings of the rear-driving elliptical trainers by developing front-driving elliptical trainers. For example, Taiwan Patent No. 499973 provides an improved elliptical trainer, whose main body is pivotally provided with arms rods topped by handles. The arms rod has its lower end pivotally connected to a link that is further pivotally connected to a sliding rod equipped with a pedal. A transmission deposited at the front part of the main body serves to drive a rotating shaft whose end connected to a crank shaft. The crank is pivotally connected to one end of the sliding rod, while an opposite end of the sliding rod is allowed to slide in a guide of a sliding seat on the main body. The prior art device is characterized in that the crank shaft comprises a primary part and a secondary part that are connected by an electric telescopic mechanism therebetween. Thereby, a user can control the crank shaft to adapt the elliptical track to his/her individual body height and habitus.

However, since the telescopic mechanism is attached to the crank, the resulting variation of the elliptical track of the elliptical trainer shows both in the major and minor axes of the elliptical track, causing the elliptical track to be less ergonomically satisfying. Also, the combination of the crank and the telescopic mechanism makes the stride adjustment of the elliptical trainer limited by the volume of the main body.

Hence, it would be desirable to eliminate the shortcomings of the prior art.

SUMMARY OF THE INVENTION

One objective of the present invention is to provide an elliptical trainer with a variable track, wherein the elliptical track varies by expanding or retracting along only its major axis, thereby allowing the elliptical trainer to be more ergonomic and adaptive to users having various body heights and habitus.

To achieve this end, in the present invention, an elliptical trainer with a variable track comprises a base, a left linkage, a right linkage, a transmission, a left adjusting assembly, and a right adjusting assembly. The base rests on the ground and has an upright post extending upward from its front end. The left and right linkages are pivotally connected to two sides of the upright post and hung over two sides of the base. The linkage comprises a pedal set that slides with respect to the linkage. The transmission is deposited on the upright post and drives the pedal sets of the linkages to perform a reciprocal motion along an elliptical track. The left and right adjusting assemblies are pivotally connected to the upright post for changing the elliptical track of the pedals.

Thereby, in the present invention, since the adjusting assembly is arranged between the upright post and the corresponding pedal, but not connected to the crank, the elliptical track of the pedal varies by expanding or retracting along only a major axis thereof. When using the elliptical trainer, a user will not need to step higher as the elliptical track expands. This design is more ergonomic and adaptive to users with various body heights and habitus For further illustrating the means and functions by which the present invention achieves the certain objectives, the following description, in conjunction with the accompanying drawings and preferred embodiments, is set forth as below to illustrate the implement, structure, features and effects of the subject matter of the present invention in a non-limiting manner.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
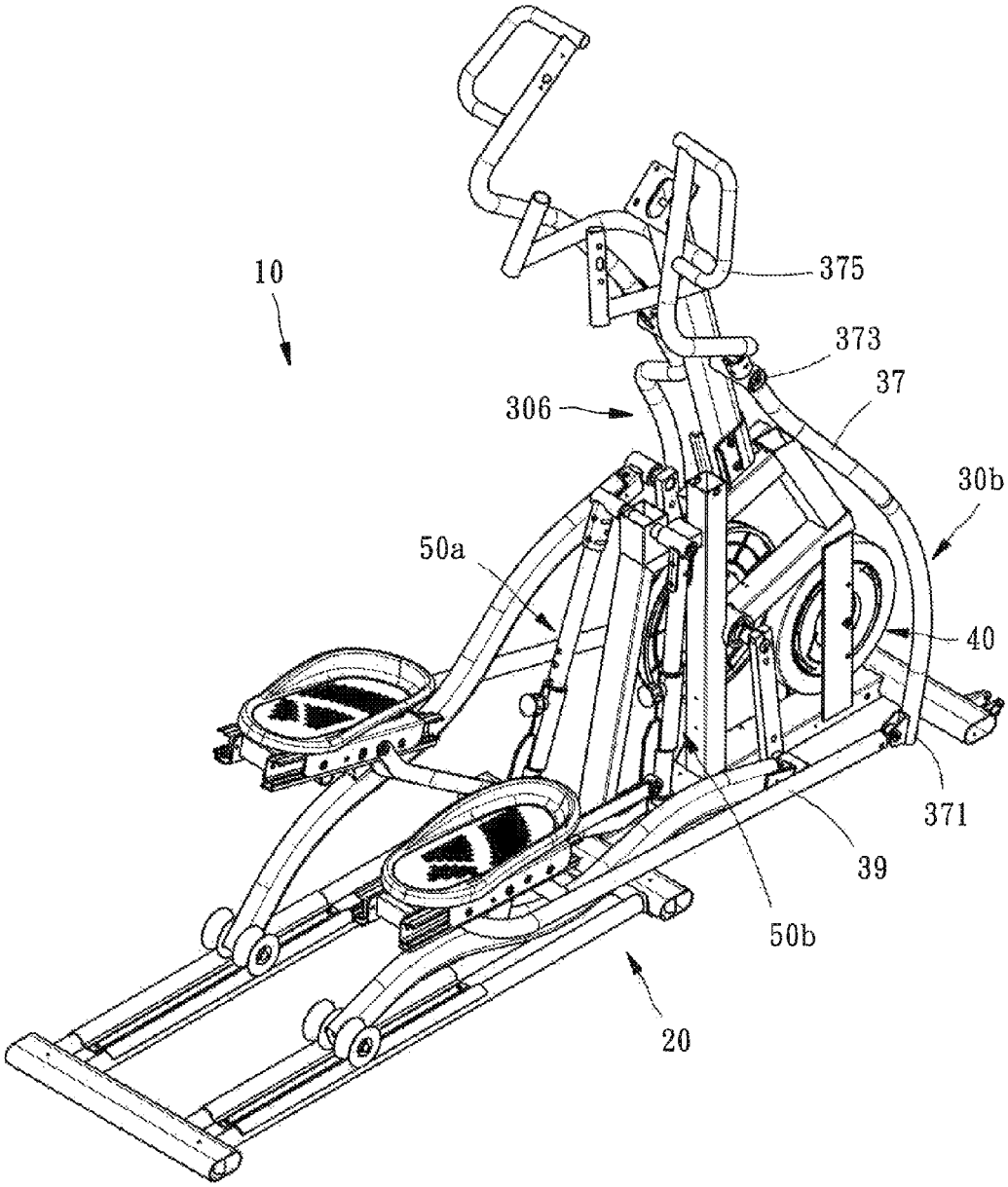
FIG. 1 is a perspective view of one preferred embodiment of the present invention.
Figure 2:
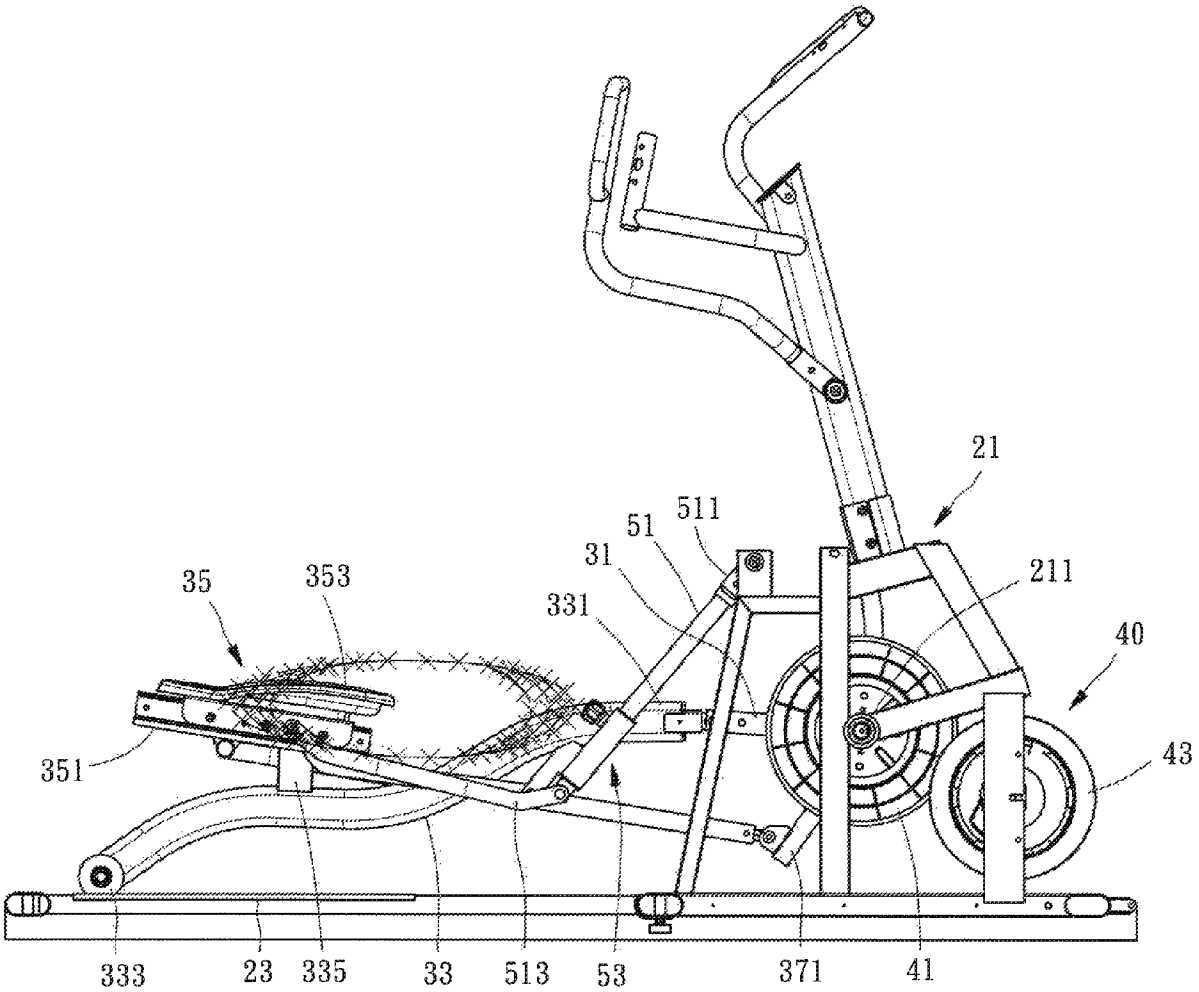
FIG. 2 is a side view of the preferred embodiment of the present invention.
Figure 3:
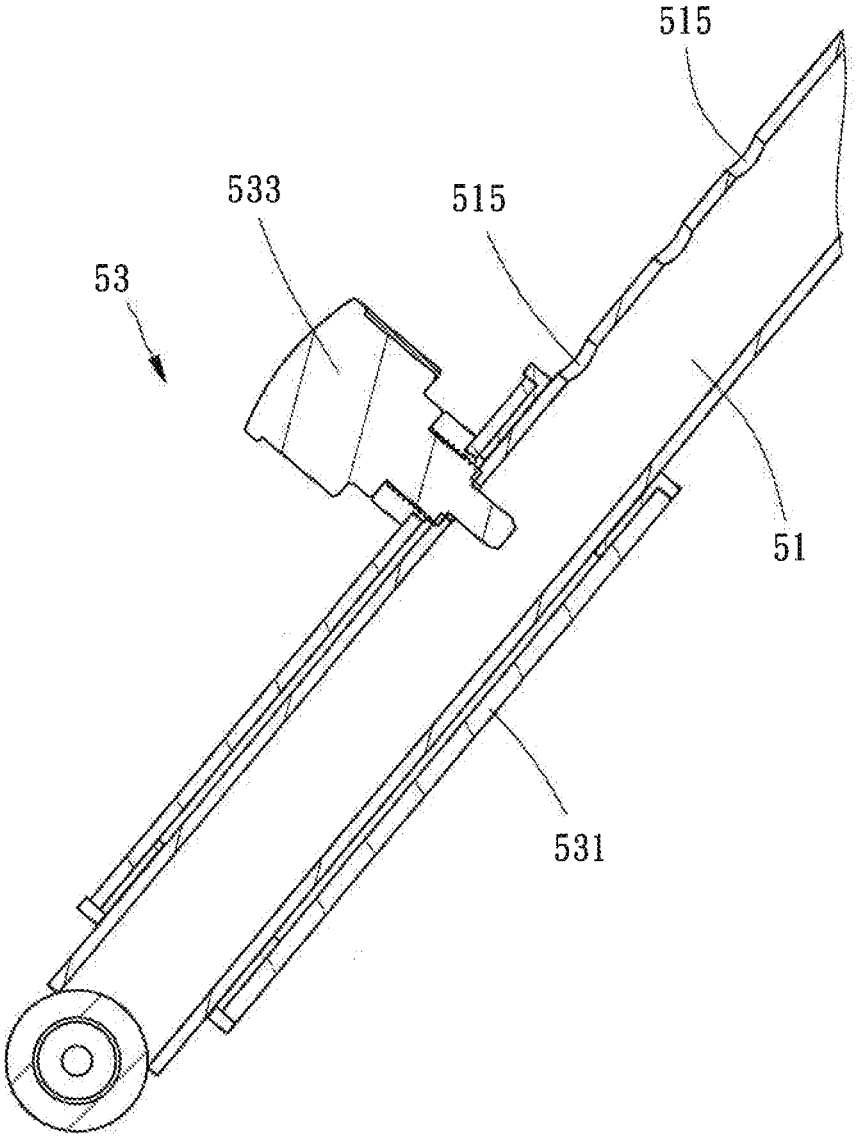
FIG. 3 is a partial, cross-sectional view of the preferred embodiment of the present invention, showing components of an adjusting unit.

Referring to FIG. 1 through FIG. 4, in a first preferred embodiment of the present invention, an elliptical trainer 10 comprises a base 20, a left and a right linkage 30*a*, 30*b*, a transmission 40, and a left and a right adjusting assembly 50*a*, 50*b*.

The base 20 rests on the ground with its front end extending upward with an upright post 21 and its rear end provided with a sliding rail 23. The upright post has an axle 211.

The left linkage 30*a* and the right linkage 30*b* are pivotally connected to two sides of the upright post 21 and hung over two sides of the base 20, respectively. Each of the linkages 30*a*, 30*b* includes a crank 31, a supporting shaft 33, a pedal set 35, an arm rod 37 and a link 39. The crank 31 has one end rotatably connected to the axle 211 of the upright post 21. The supporting shaft 33 has a connecting portion 331, a sliding portion 333 and a supporting portion 335. The crank 31 has an opposite end pivotally connected to the connecting portion 331. The sliding portion 333 can slide to and fro along the sliding rail 23 on the base 20. The pedal set 35 has a retaining portion 351 and a pedal 353. The retaining portion 351 is pivotally connected to the supporting portion 335 and fixedly connected to one end of the link 39. The arm rod 37 has a lower pivotal joint 371, a higher pivotal joint 373 and a handle 375. The link 39 has an opposite end pivotally connected to the lower pivotal joint 371. The handle 375 is for a user's hand to grip. The higher pivotal joint 373 is pivotally connected to the upright post 21, so that the arm rod 37 can swing to and fro against the higher pivotal joint 373.

The transmission 40 is deposited on the upright post 21 and serves to drive the pedal sets 35 of the linkage 30*a*, 30*b* to perform a reciprocal motion along an elliptical track. The transmission 40 includes a driving wheel 41 and a freewheel 43. The driving wheel 41 is pivotally connected to the axle 211 of the upright post 21 and can be driven by the cranks 31 to rotate. The freewheel 43 is pivotally connected the front end of the base 20. In the present embodiment, a belt is arranged between the driving wheel 41 and the freewheel 43 as a medium for power transfer.

Figure 4:
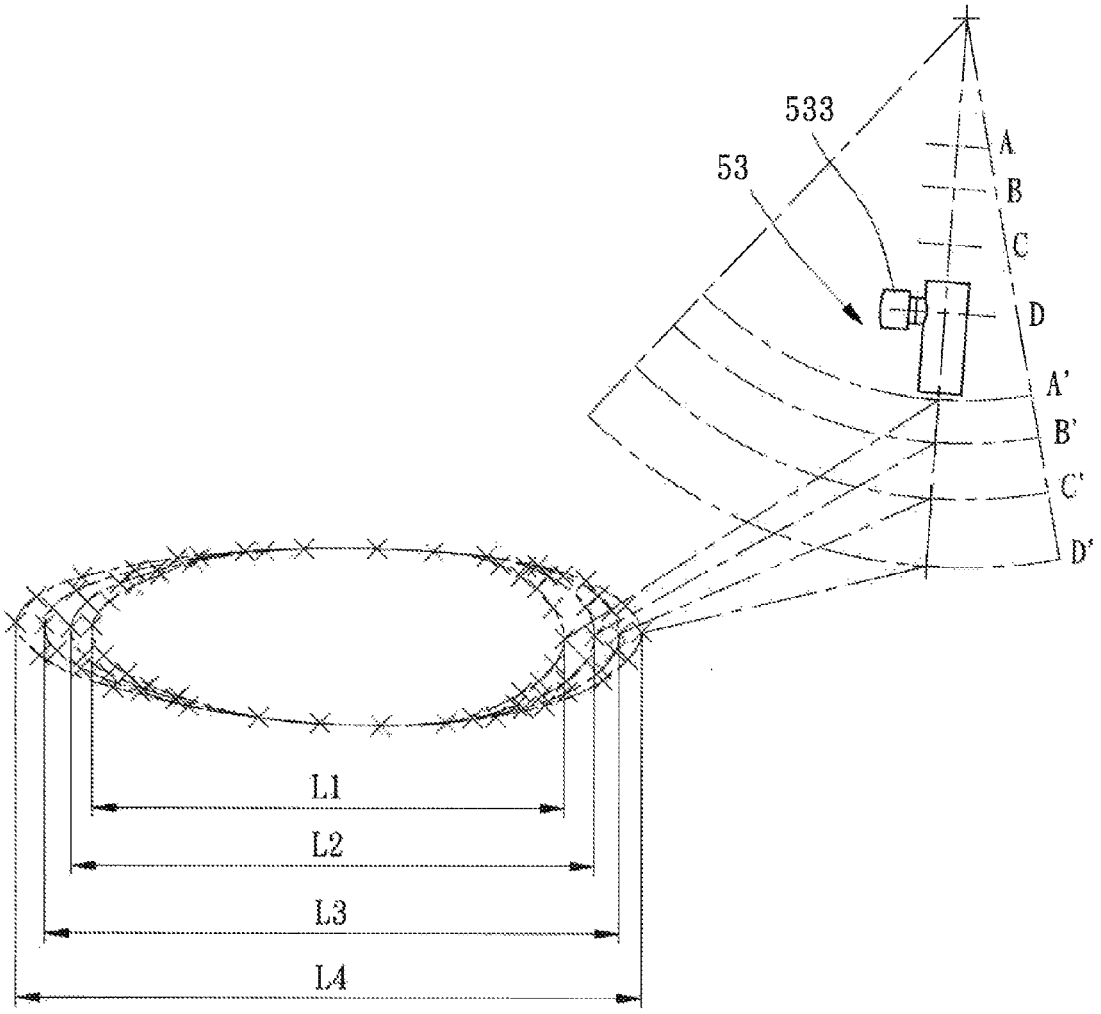
FIG. 4 is a schematic drawing illustrating the elliptical track of the present invention the preferred embodiment the preferred embodiment of the present invention, particularly showing how the elliptical track varies when the adjusting unit is set differently.

The left adjusting assembly 50*a* and the right adjusting assembly 50*b* each include a connecting shank 51 and an adjusting unit 53 that is connected to the pedal and can axially move along the connecting shank 51. The connecting shank 51 has a pivot end 511, a free end 513 and a plurality of through holes 515 formed between the two ends. The pivot end 511 is pivotally connected to the upright post 21, and the free end 513 is pivotally connected to the pedal 353 for allowing the pedal 353 to have its elliptical track changed. The adjusting unit 53 has a sleeve 531 and a fastener 533 that is movably attached to the sleeve 531. The sleeve 531 is mounted around the connecting shank 51. The fastener 533 is engaged with one of the through holes 515, so as to position the sleeve 531 with respect to the connecting shank 51. As shown in FIG. 4, when a user set the fastener 533 of the adjusting unit 53 in a site A, the free end 513 of the connecting shank 51 corresponds to the site A', and the pedal 353 moves along the elliptical track having a stride length L1. When the fastener 533 of the adjusting unit 53 is set at a site B, the free end 513 of the connecting shank 51 corresponds to the site B', and the pedal 353 moves along the elliptical track having a stride length L2. Similarly, when the fastener 533 is set at a site C or D, the free end 513 of the connecting shank 51 corresponds to the site C' and D', and the elliptical track of the pedal 353 has a stride length L3 or L4. In the present embodiment, the foregoing stride lengths are corresponding to those generated by 16", 18", 20" and 22" elliptical trainers, respectively.

Figure 5:
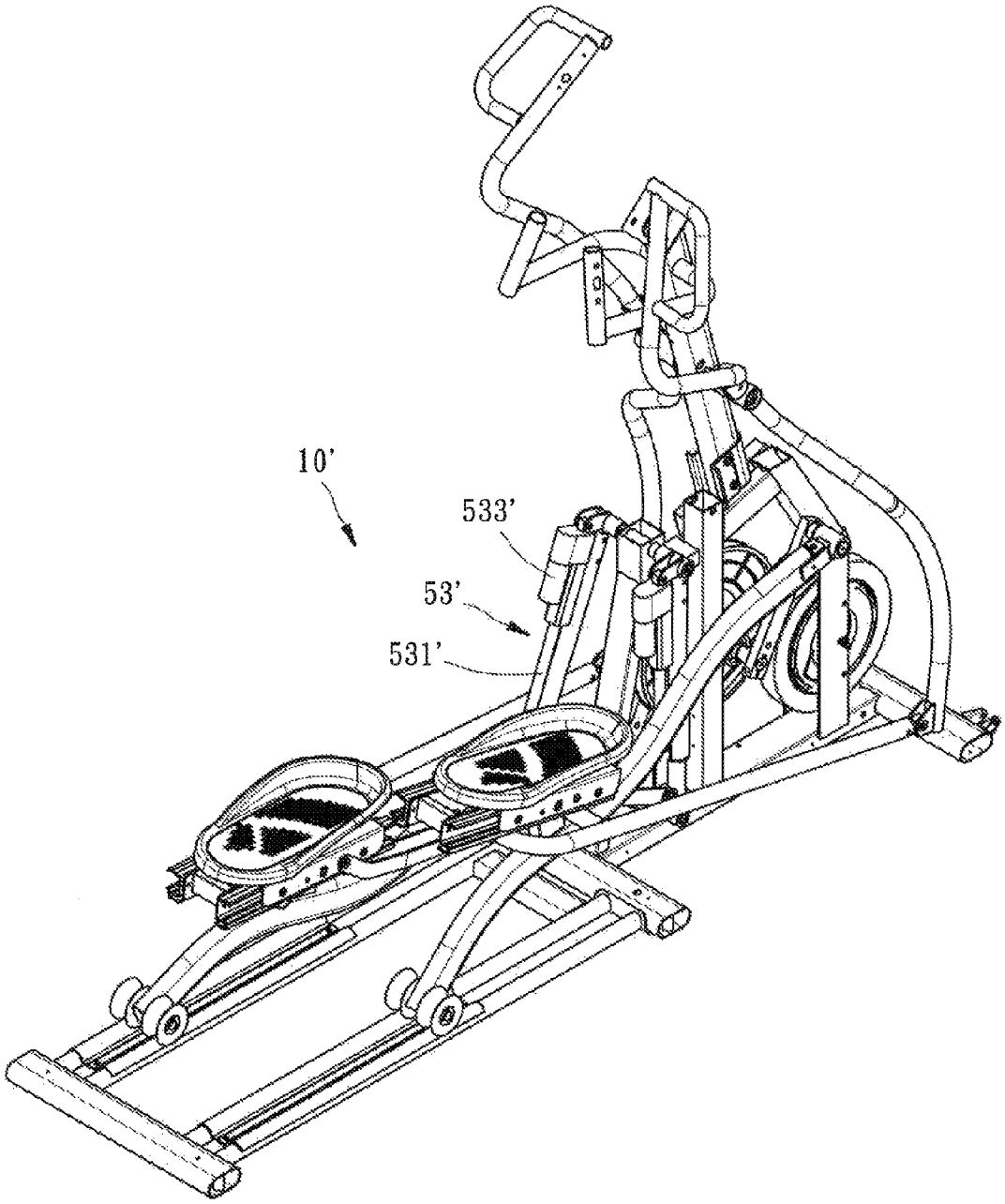
FIG. 5 is a perspective view of another preferred embodiment of the present invention.
Figure 6:
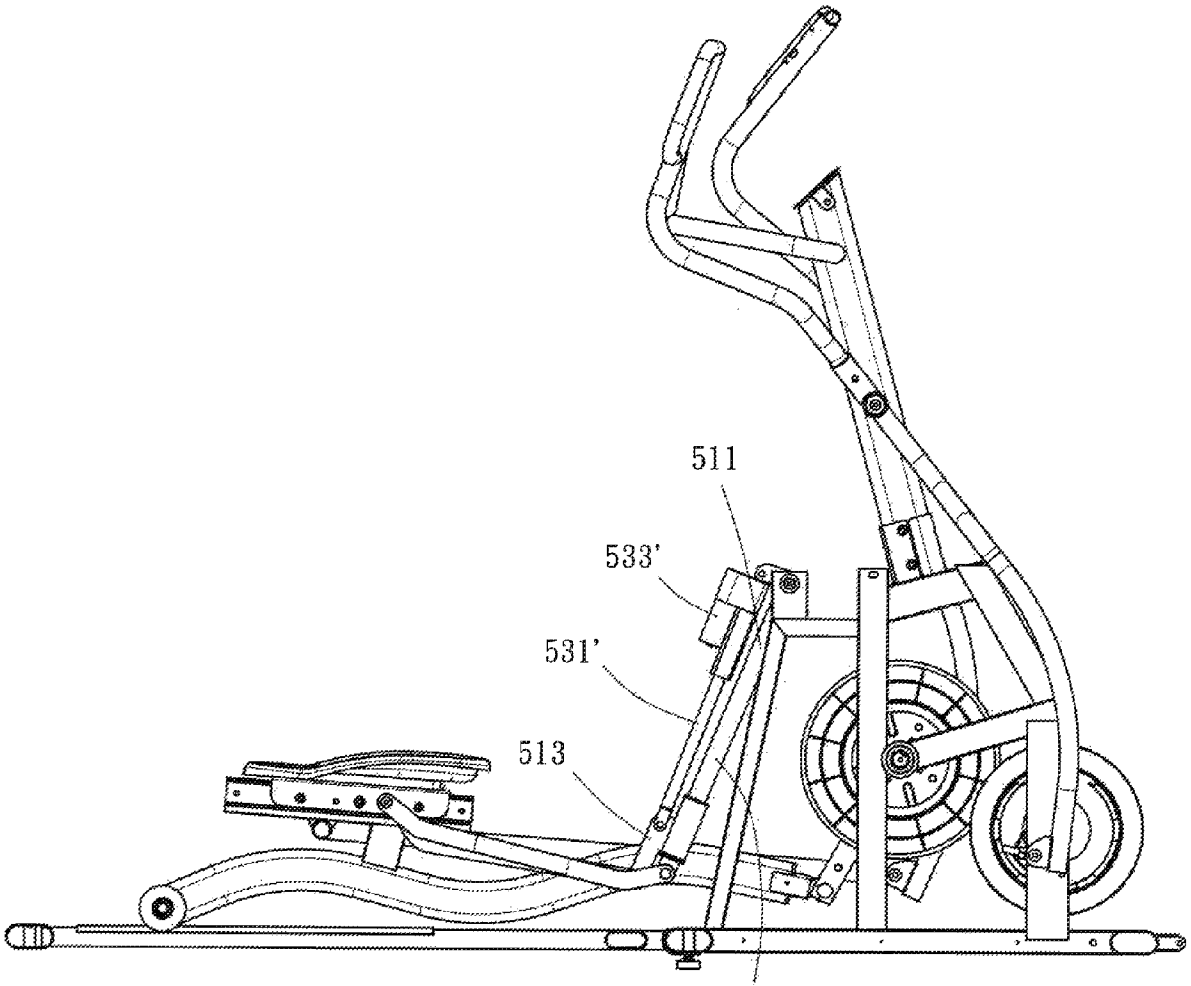
FIG. 6 is a side view of the second preferred embodiment of the present invention.

Now referring to FIG. 5 and FIG. 6, in a second preferred embodiment of the present invention, an elliptical trainer 10' has a power-driven adjusting unit 53' instead of the manual adjusting unit 53. As shown, each of the adjusting units 53' has a screw 531' and a linear actuator 533' that drives the screw 531' to stretch or retract. The screw 531' has one end connected to the linear actuator 533', and an opposite end fixed to the free end 513 of the connecting shank 51, so that the free end 513 can approach or leave from the pivot end 511.

To sum up, the adjusting assemblies 50*a*, 50*b* are each provided between the upright post 21 and the pedal 35, instead of being connected to the crank 31, so the elliptical track of the pedal 35 varies by expanding or retracting along only a major axis thereof. When using the elliptical trainer, a user will not need to step higher as the elliptical track expands. This design is more ergonomic and adaptive to users with various body heights and habitus.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An elliptical trainer with a variable track, the elliptical trainer comprising:

a base, lying on the ground and having an upright post extending upward from a front end thereof;

a left linkage and a right linkage, being pivotally connected to the upright post and hung over two sides of the base, respectively, wherein each of the linkages has a pedal set that slides to and fro with respect to the linkage;

a transmission, being deposited on the upright post and driving the pedal sets of the linkages to perform reciprocal motions in respective elliptical tracks; and a left adjusting assembly and a right adjusting assembly, being pivotally connected to the upright post for adjusting the elliptical tracks of the pedals, respectively;

wherein each said adjusting assembly comprises a connecting shank and an adjusting unit that is connected to the pedal and can axially move along the connecting shank, in which the connecting shank has a pivot end and a free end, the pivot end being pivotally connected to the upright post, and the free end being pivotally connected to the pedal; and wherein the adjusting unit has a screw and a linear actuator that drives the screw to extend or retract, the screw having one end connected to the linear actuator and an opposite end fixed to the screw free end of the connecting shank, so that the free end is driven to approach or leave from the pivot end; and wherein the upright post has an axle, and each said linkage including a crank, a supporting shaft, an arm rod and a link, the crank having one end rotatably connected to the axle of the upright post, the supporting shaft having a connecting portion, a sliding portion and a supporting portion, the crank having an opposite end pivotally connected to the connecting portion, the sliding portion being allowed to slide to and fro on the base, the pedal set having a retaining portion and a pedal, the retaining portion pivotally connected to the supporting portion and fixed to one end of the link, the arm rod having a lower pivotal joint, a higher pivotal joint and a handle, the link having an opposite end pivotally connected to the lower pivotal joint, the handle being provide for a user's hand to grip, and the higher pivotal joint being pivotally connected to the upright post so that the arm rod is allowed to swing to and fro against the higher pivotal joint.

2. The elliptical trainer of claim 1, wherein a sliding rail is provided on a rear end of the base for the sliding portions of the linkages to slide thereon.

3. The elliptical trainer of claim 1, wherein the transmission comprises a driving wheel and a freewheel, the driving wheel being pivotally connected to the axle and rotated by the cranks, the freewheel being pivotally connected to the front end of the base, and a belt being arranged between the driving wheel and the freewheel as a medium for power transfer.

* * * * *